US006662565B2

(12) United States Patent
Brundish et al.

(10) Patent No.: US 6,662,565 B2
(45) Date of Patent: Dec. 16, 2003

(54) FUEL INJECTORS

(76) Inventors: Kevin David Brundish, 25 Britten Close, Ash Surrey (GB), GU12 6LS; Leigh Christopher Morgan, 32 Berwick Drive, Burnley, Lancashire (GB), BB12 0TN; Alan Joseph Wheatley, 7 Holme Close, Erby, Barnoldswick Lancashire (GB), BB18 6UG ( * ) Notice: Subject to any disclaimer, the term of this patent is extended or adjusted under 35 U.S.C. 154(b) by 29 days.

(21) Appl. No.: 09/982,776

(22) Filed: Oct. 22, 2001

(65) Prior Publication Data

US 2002/0088234 A1 Jul. 11, 2002

(30) Foreign Application Priority Data

Oct. 20, 2000 (GB) ..... 0025765

(51) Int. Cl.[7] ..... F23R 3/14

(52) U.S. Cl. ..... 60/742; 60/748; 239/404; 239/405; 239/406

(58) Field of Search ..... 60/742, 748, 750, 60/39.463; 239/400, 403, 404, 405, 406; 431/182, 183

(56) References Cited

U.S. PATENT DOCUMENTS 3,684,186 A * 8/1972 Helmrich ..... 60/742
4,562,698 A * 1/1986 Halvorsen et al. ..... 60/742
4,798,330 A * 1/1989 Mancini et al. ..... 239/406
4,977,740 A * 12/1990 Madden et al. ..... 60/742
5,505,045 A 4/1996 Lee et al.
6,161,387 A 12/2000 Green
6,272,840 B1 8/2001 Crocker et al.
6,315,551 B1 * 11/2001 Salzsieder et al. ..... 239/406
6,381,964 B1 * 5/2002 Pritchard et al. ..... 60/746

FOREIGN PATENT DOCUMENTS

| | | |
|---|---|---|
| EP | 0927854 A2 | 7/1999 |
| EP | 1045202 A1 | 10/2000 |
| EP | 1058062 A1 | 12/2000 |
| GB | 2017289 A | 10/1979 |
| GB | 2072827 A | 10/1981 |

OTHER PUBLICATIONS

Clifford E. Smith et al., Journal of Propulsion and Power, XP000497931, 1995, No. 2, pp. 244–251, Dual–Spray Airblast Fuel Nozzle for Advanced Small Gas Turbine Combustors.

* cited by examiner

*Primary Examiner*—Ted Kim
(74) *Attorney, Agent, or Firm*—Connolly Bove Lodge & Hutz LLP

(57) ABSTRACT

A duplex fuel injector has concentric arrangement of an inner air swirler, an inner fuel injection port, an intermediate axial air filmer, a second air swirler, an outer fuel injection port and an outer air swirler. The intermediate air filmer produces a curtain of air separating an outer air and fuel spray from an inner air and fuel spray. The outer spray is used in a pilot combustion zone whereas the inner spray is used in a main combustion zone.

9 Claims, 2 Drawing Sheets

FUEL INJECTORS

BACKGROUND OF THE INVENTION

This invention relates to air blast fuel injectors of the type in which fuel is atomised by a fast flowing stream of air to produce a fuel-air spray.

A known air blast fuel injector comprises a concentric arrangement of air and fuel injection ports through which air and fuel are injected so that a swirling cone of air meets a conical film of fuel and produces an annular spray. A simplex type of injector has a single fuel supply. A duplex type of injector has pilot and main fuel supplies, each of which is atomised by a corresponding swirl of air. For example, a known duplex air blast fuel injector comprises a concentric arrangement of an inner air swirler, a pilot fuel filmer, an intermediate air swirler, a main fuel filmer and an outer air swirler. This arrangement claims to produce a pilot spray in an inner recirculation or combustion zone and a main fuel spray in an outer recirculation or combustion zone, but performance and stability tests indicate that the main fuel spray is not independent of the pilot fuel spray. The position of the pilot zone internally of the main zone may make it difficult to ignite reliably.

BRIEF SUMMARY OF THE INVENTION

It is an object of the invention is to provide a alternative duplex air blast fuel injector.

According to one aspect of the present invention there is provided an air blast fuel injector comprising inner and outer fuel injection ports, first and second air swirlers associated with said inner and outer fuel injection ports to direct air and fuel sprays into inner and outer recirculation zones, the outer zone being arranged to be a pilot combustion zone and the inner zone being arranged to be a main combustion zone.

Preferably, the first air swirler is located inside the inner fuel injection port, the second air swirler is located inside the outer fuel injection port and the injector includes an intermediate air filmer located between the inner fuel injection port and the second air swirler arranged to produce an intermediate curtain of air separating the air and fuel mixtures in the two zones.

According to a second aspect of the present invention there is provided an air blast fuel injector comprising inner and outer fuel injection ports, first and second air swirlers associated with the inner and outer fuel injection ports to direct air and fuel sprays into inner and outer recirculation zones, and an intermediate air filmer between the inner and outer fuel injection ports arranged to produce an intermediate curtain of air separating the air and fuel mixtures in the two zones.

The intermediate air filmer is preferably located between the inner fuel injection port and the second air swirler. The intermediate air filmer is preferably an axial air filmer. The intermediate air filmer may be arranged to produce a low swirl compared with that of the inner air swirler. The fuel injector may include an outer air swirler located outside the outer fuel injector. The inner fuel spray is preferably arranged to have an angle of substantially 90° and the outer fuel spray is preferably arranged to have an angle of substantially 140°.

The invention will now be described by way of example with reference to the accompanying drawings.

DESCRIPTION OF THE PREFERRED EMBODIMENT

Figure 2:
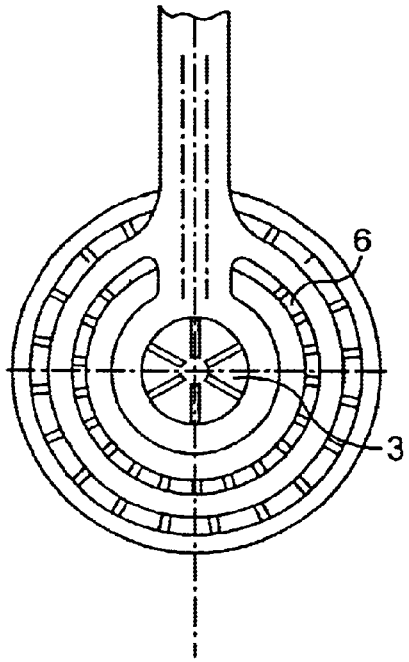
FIG. 2 is a front elevation of the injector of FIG. 1.
Figure 1:
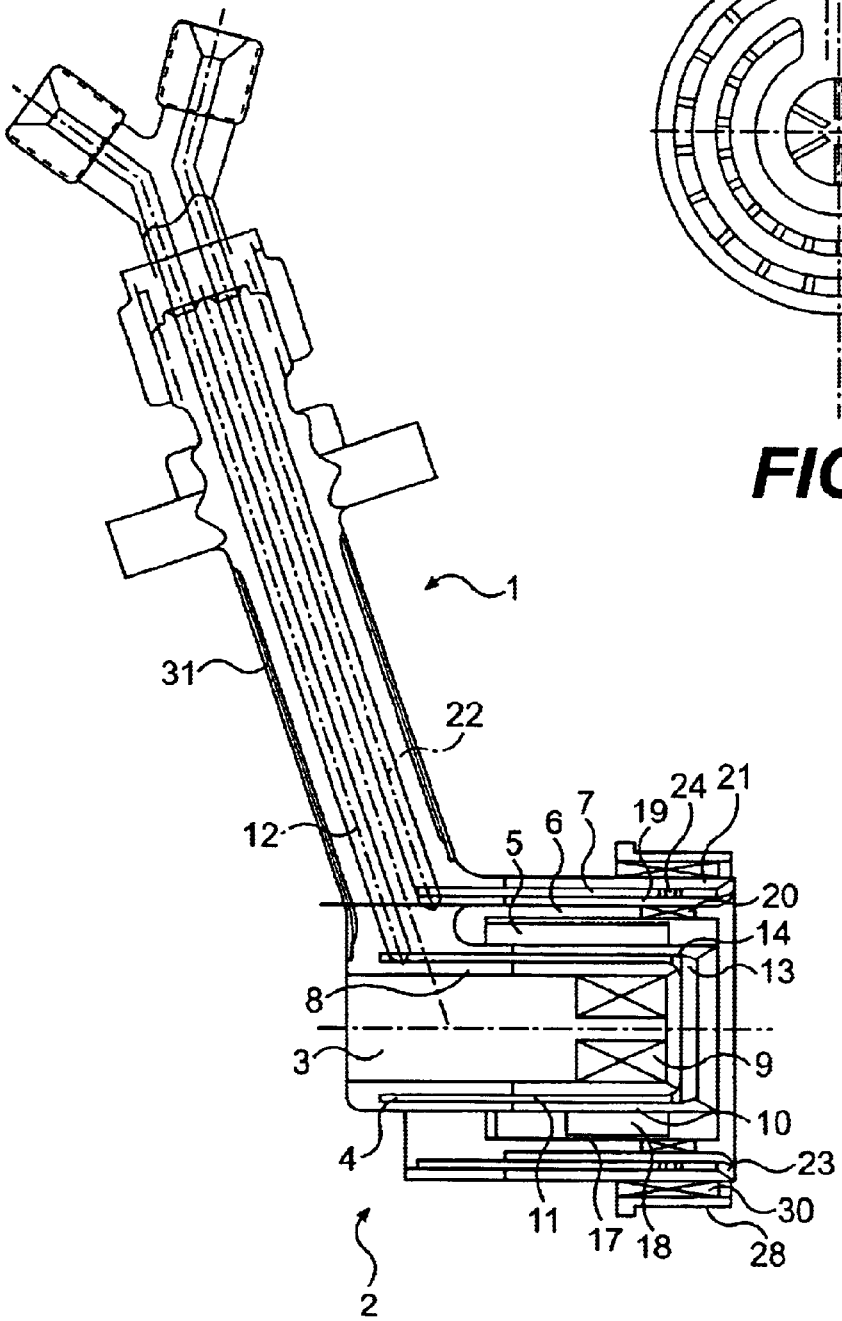
FIG. 1 is a section through an air blast injector according to the invention.
Figure 3:
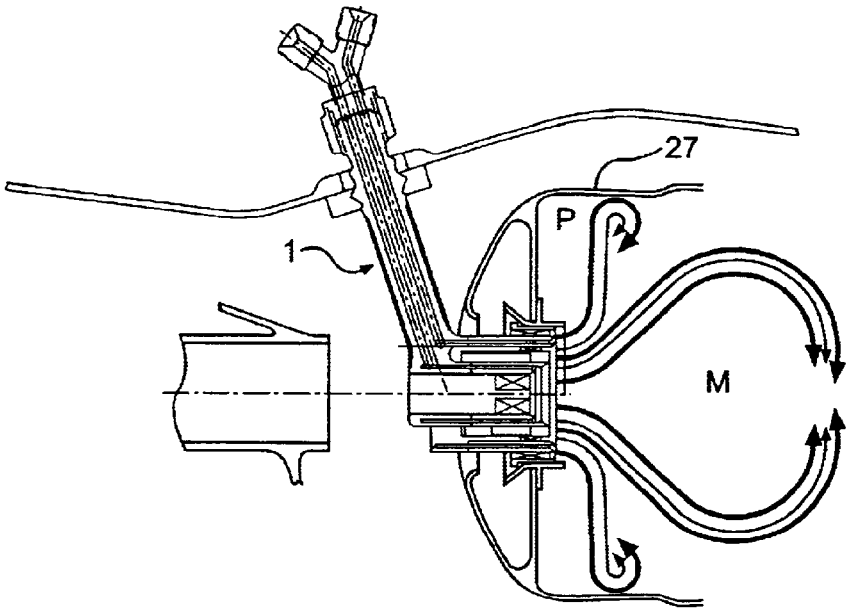
FIG. 3 is a diagrammatic view of the injector of FIG. 1 fitted in the combustor of a gas turbine engine showing the flow pattern of the injector sprays.

The illustrated injector 1 consists of a nozzle 2 formed by a series of concentric components which define an inner air swirler 3, an inner fuel filmer 4, an intermediate axial air filmer 5, an outer air swirler 6, and an outer fuel filmer 7.

The inner air swirler 3 comprises a tube 8 formed with internal swirler blades 9 that serve to swirl the air flow passing through it. The inner fuel filmer 4 consists of a sleeve 10 fitted over the tube 8 to form an annular channel 11 between the two through which a supply of fuel flows from a supply channel 12 to an annular injector port 13 fitted with swirler blades 14. The flow of swirling air from the tube 8 passes the fuel injector port 13 and mixes with and atomises the fuel spray, and the resulting spray of fuel and air is directed by virtue of the swirl as a conical spray with a re-circulating flow pattern in a central main combustion zone M shown in FIG. 2. Typically, the swirler blades 9, 14 are set at an angle of 45 degrees to give a spray cone of 90 degrees.

The intermediate axial air filmer 5 is formed by a tube 17 mounted around the sleeve 10 by axial vanes 18 so as to form an airflow channel that delivers an axial flow of air that converges on the profile of the spray produced by the inner air swirler 3. The intermediate air filmer may also incorporate swirler blades that produce a low swirl so that the resulting air curtain still converges on the profile of the spray produced by the inner air swirler. At the extreme, if the swirler blades of the intermediate air filmer were set at a swirl angle greater than that of the blades of the inner air swirler, then the respective air flows would diverge and the air curtain would have less of a containing effect on the inner recirculation zone.

The outer air swirler 6 is formed by a tube 19 around the tube 17 with swirler blades 20 between the two so as to swirl the flow of air passing through it. The outer fuel filmer 7 is formed by a sleeve 21 around the tube 19 that forms an annular channel between the two through which a supply of fuel flows from a supply channel 22 to an annular injector port 23 fitted with swirler blades 24. The flow of swirling air from the tube 19 passes the fuel injector port 23 and atomises the fuel to produce a conical spray which flows radially outwardly, as shown in FIG. 2. Typically, the swirler blades 20, 24 are set at an angle of 70 degrees to give a wide spray cone of 140 degrees which flows radially outwardly to the combustor side wall 27, and recirculate in the outer annular zone P shown in FIG. 2, which is a pilot combustion zone. The pilot combustion zone P is supplied with a relatively small continuous flow of fuel whereas the main combustion zone is supplied with a greater flow of fuel, which may vary and be discontinuous.

As an optional feature, the injector may have an outermost air swirler 28 comprising a short sleeve fitted over the outer sleeve 21 with swirler blades 30 therebetween, typically set at an angle of 70 degrees. This produces a further swirling flow of air which flows outwardly with the spray into the annular pilot combustion zone P.

Figure 4:
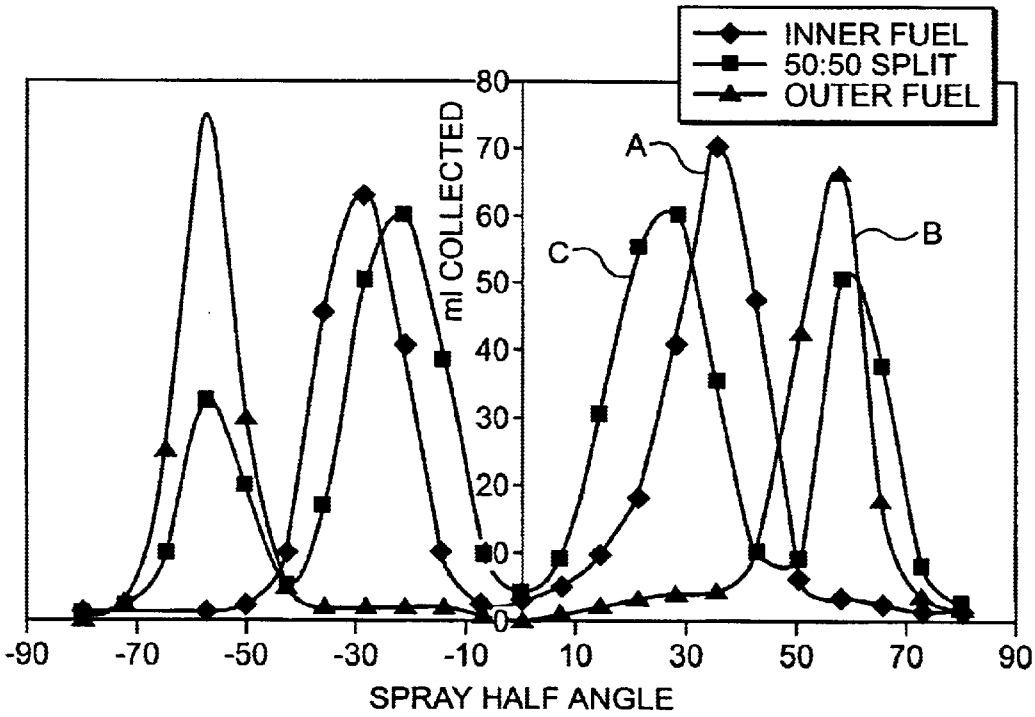
FIG. 4 is a graph of fuel flux measurements made in the spray zones of the injector of FIG. 1.

It will be appreciated that the axial flow of air produced by the intermediate air filmer 5 flows forwards and converges with the inner fuel and air spray and tends to form an air curtain which continues this spray in the central main combustion zone M and separates it from the outer spray in the annular pilot combustion zone P. This separation of the combustion zones can be measured using a collection tube rake arrangement which samples the fuel flux in the combustor, and the results shown in FIG. 4, illustrate the separation between the two combustion zones M and P. Graph A shows the fuel flux for fuel supplied by the inner fuel filmer 4 alone, graph B shows the fuel flux for fuel supplied by the outer fuel filmer 7 alone, and graph C shows the fuel flux when fuel is supplied equally by both the inner and outer fuel filmers.

In the illustrated embodiment, the nozzle 2 of the injector is supported at the end of an arm 31 which serves as a fuel supply conduit carrying the two separate supplies 12 and 22. The nozzle is located in an air stream as shown in FIG. 2 so that air is supplied to all of the air swirlers 3, 6, 28 and axial air filmer 5.

In a preferred example, the combustion zone P acts as a combustion zone for pilot operation, and the combustion zone M acts as the main combustion zone, each being fuelled accordingly. Because the pilot combustion is located outside the main combustion zone it is considerably easier to ignite than would be the case if it were located within the main zone.

Spraying fuel into separate zones of an engine combustor, allows fuel placement to be varied over different engine operating conditions, for example, using a first zone with a wide spray distribution and a tight re-circulation flow pattern near the injector for pilot operation, and using a second zone with a long narrow re-circulation flow pattern on the combustor centre-line for the main fuel supply under full load operation. The fuel spray in the first zone for pilot operation can be optimised for good ignition and good handling performance, and the fuel spray in the second zone for main operation can be optimised for good emissions performance. Between the pilot and main operating conditions, the two sprays can be controlled to allow combustion optimisation throughout the operating envelope of the engine.

Fuel injection in the first zone can be enriched, and fuel injection in the second zone correspondingly weakened so as to ensure combustion stability under rapid deceleration conditions when the fuel supply may be cut down to an idle level while the airflow is momentarily maintained and could result in flame extinction. Control of fuel placement such as is offered by the invention is especially beneficial for aero engines which operate at high pressure, temperature and turndown ratio, where the ratio between maximum and flight idle conditions is extreme. However, injectors according to the invention are also applicable to any liquid-fuelled gas turbine including military or civil aerospace turbofans with kerosene injection, marine and ground-based gas turbines with diesel or kerosene injection.

What we claim is:

1. An air blast fuel injector comprising:

inner and outer fuel injection ports;

first and second air swirlers associated with said inner and outer fuel injection ports to direct air and fuel sprays into inner and outer recirculation zones, wherein said first air swirler is located inside said inner fuel injection port and said second air swirler is located inside said outer fuel injection port, and wherein said outer recirculation zone is a pilot combustion zone and said inner recirculation zone is a main combustion zone; and an intermediate air filmer between said inner injection port and said second air swirler, wherein said intermediate air filmer is arranged to produce an intermediate curtain of air separating air and fuel mixtures into said inner and outer recirculation zones.

2. A fuel injector according to claim 1, wherein said intermediate air filmer is an axial air filmer.

3. A fuel injector according to claim 1, wherein said intermediate air filmer is arranged to produce a low swirl compared with that of said inner air swirler.

4. A fuel injector according to claim 1 including an outer air swirler located outside said outer fuel injection port.

5. A fuel injector according to claim 1, wherein said inner fuel spray is arranged to have an angle of substantially 90°.

6. A fuel injector according to claim 1, wherein said outer fuel spray is arranged to have an angle of substantially 140°.

7. A fuel injector comprising: a first air swirler; an inner fuel injection part located concentrically outside said first air swirler; an intermediate air filmer located concentrically outside said inner fuel injection port; a second air swirler located concentrically outside said air filmer; and an outer fuel injection port located concentrically outside said second air swirler; wherein the first and second air swirlers and the inner and outer fuel injection ports are arranged to produce air and fuel mixtures; wherein said air filmer is arranged to produce an intermediate curtain of air such that said air and fuel mixtures are separated into inner and outer recirculation zones; and wherein said outer recirculation zone is a pilot combustion zone and said inner recirculation zone is a main combustion zone.

8. A fuel injector according to claim 7, wherein said intermediate air filmer is an axial air filmer.

9. A fuel injector according to claim 7, including a third air swirler located concentrically outside said outer fuel injection port.

* * * * *